US007121915B2

(12) United States Patent
Banks

(10) Patent No.: US 7,121,915 B2
(45) Date of Patent: Oct. 17, 2006

(54) DISTORTING SHAPED BALLOON

(75) Inventor: Emily M. Banks, 3861 Coastal Hwy., St. Augustine, FL (US) 32084

(73) Assignees: Emily M. Banks, St. Augustine, FL (US); Christopher Hill, St. Augustine, FL (US)

( * ) Notice: Subject to any disclaimer, the term of this patent is extended or adjusted under 35 U.S.C. 154(b) by 290 days.

(21) Appl. No.: 10/219,510

(22) Filed: Aug. 15, 2002

(65) Prior Publication Data

US 2004/0033755 A1 Feb. 19, 2004

(51) Int. Cl.
*A63H 27/10* (2006.01)

(52) U.S. Cl. ..... 446/220; 446/486

(58) Field of Classification Search ..... 446/220–226, 446/486

See application file for complete search history.

(56) References Cited

U.S. PATENT DOCUMENTS

| | | | | |
|---|---|---|---|---|
| D74,106 | S | 12/1927 | Gordon | |
| 4,268,030 | A | 5/1981 | Richards | |
| 4,917,646 | A | 4/1990 | Kieves | |
| 5,036,985 | A | 8/1991 | Lovik | |
| 5,108,339 | A | 4/1992 | Kieves | |
| 5,127,867 | A | 7/1992 | Lau | |
| 5,169,353 | A | 12/1992 | Myers | |
| 5,254,026 | A | 10/1993 | Kaiser | |
| 5,259,805 | A | 11/1993 | Kieves | |
| 5,338,243 | A * | 8/1994 | Kieves | 446/220 |
| 5,402,591 | A | 4/1995 | Lee | |
| 5,471,797 | A | 12/1995 | Murphy | |
| 5,603,185 | A | 2/1997 | Murphy | |
| D384,985 | S | 10/1997 | Cronic | |
| 5,713,777 | A | 2/1998 | Greenwald | |
| 5,718,684 | A * | 2/1998 | Gupta | 604/103.07 |
| 5,769,685 | A | 6/1998 | Nakamura et al. | |
| 5,795,211 | A * | 8/1998 | Carignan et al. | 446/220 |
| 5,819,448 | A | 10/1998 | Kieves et al. | |
| D414,222 | S | 9/1999 | Kieves et al. | |
| 6,076,758 | A | 6/2000 | Kieves et al. | |
| 6,152,530 | A | 11/2000 | Hsu et al. | |
| 6,389,604 | B1 * | 5/2002 | Day | 2/200.1 |
| 6,607,419 | B1 * | 8/2003 | Day et al. | 446/226 |
| 6,632,120 | B1 * | 10/2003 | Blackman et al. | 446/220 |
| 6,634,394 | B1 * | 10/2003 | Nelson et al. | 141/114 |
| 6,699,095 | B1 * | 3/2004 | Epstein | 446/222 |
| 2001/0043998 | A1 * | 11/2001 | Chen et al. | |

* cited by examiner

*Primary Examiner*—Jacob K. Ackun, Jr.
(74) *Attorney, Agent, or Firm*—Knoble Yoshida & Dunleavy, LLC

(57) ABSTRACT

An inflated non-latex balloon includes at least two latex films that are sealed together at their edges to define an encapsulation member; and an inlet connected to the encapsulation member, wherein the encapsulation member is inflated to a pressure substantially higher than a normal inflating pressure recommended for a typical non-latex balloon and wherein shape of the inflated non-latex balloon is substantially different in comparison with the shape of the balloon if the balloon is inflated to the normal inflating pressure. A method of inflating a non-latex balloon involves over-inflating the non-latex balloon to a pressure substantially higher than a normal inflating pressure recommended for a typical non-latex balloon to achieve a desired shape.

16 Claims, 4 Drawing Sheets

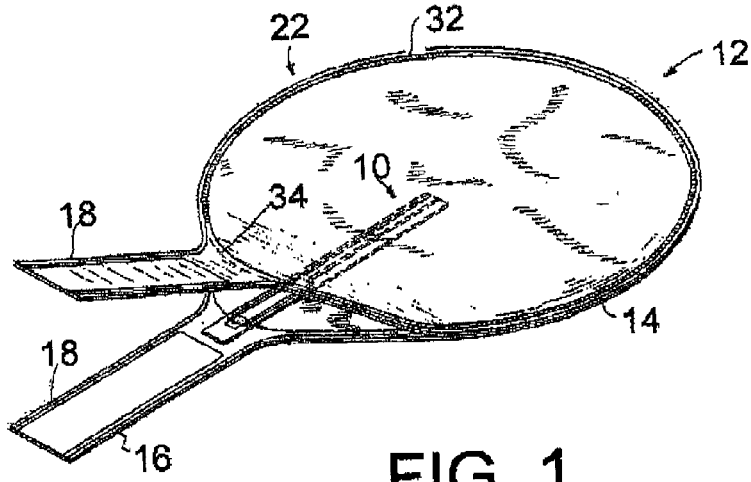
FIG. 1
FIG. 2
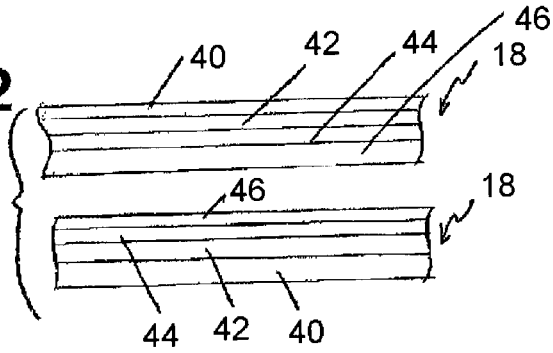
FIG. 3
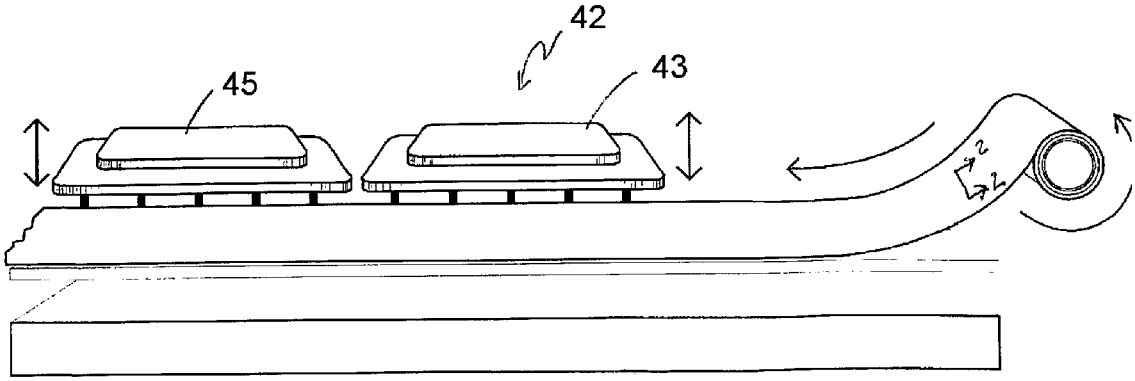

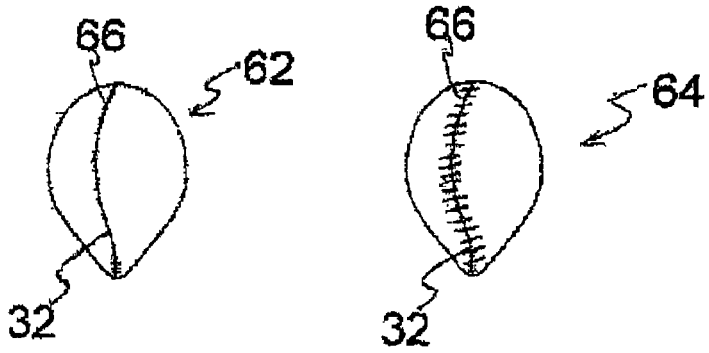
FIG. 6
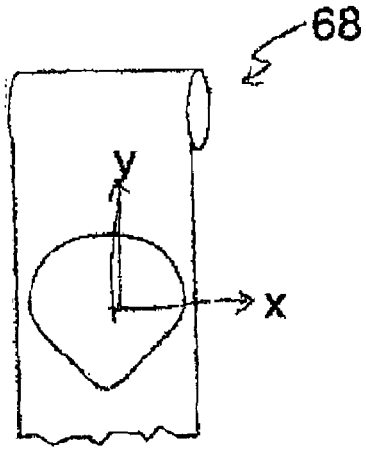
FIG. 7
FIG. 8
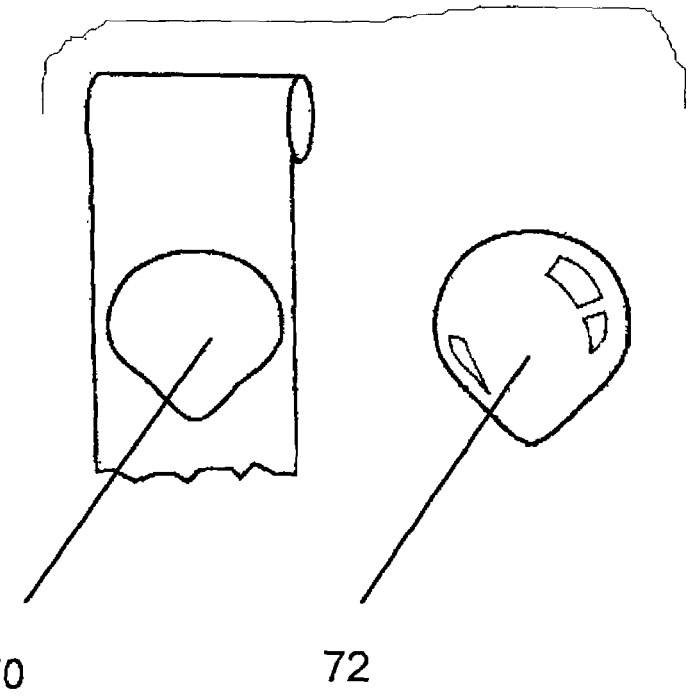

FIG 9
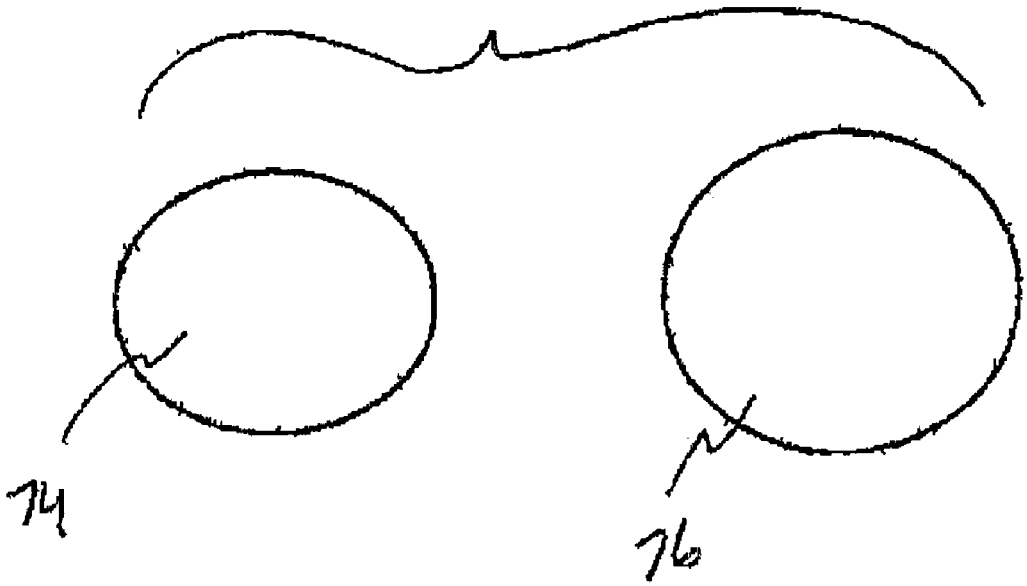
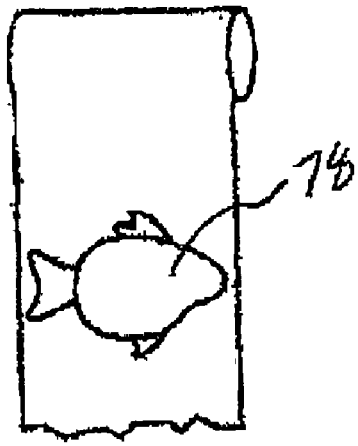
FIG 10
FIG 11
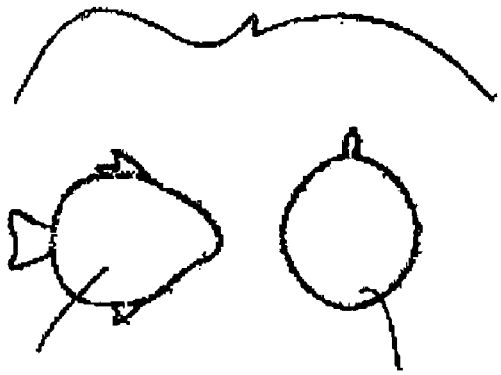

DISTORTING SHAPED BALLOON

BACKGROUND OF THE INVENTION

1. Field of the Invention

The invention relates generally to a non-latex balloon and a method of manufacturing and inflating a non-latex balloon. More specifically, this invention relates to a non-latex balloon that is designed to be inflated to a pressure higher than a normally recommended inflation pressure for such a balloon, and a method of inflating a non-latex balloon to the higher pressure.

2. Description of the Related Technology

Balloons have been in use for generations as playthings and decorations for parties and other special occasions. Traditionally, balloons were fabricated from a latex material. Recently, however, a concern has developed over the safety of the latex material, particularly for those who have an allergy to latex. Many hospitals and long-term care facilities for these reasons are discouraging or prohibiting the use of latex balloons.

For these reasons, the popularity of non-latex balloons has grown tremendously lately. This type of balloon is typically formed of two flexible plastic sheets, which are heat sealed together to form an encapsulation member. Non-latex balloons are available in many different styles and aesthetic configurations (e.g., a circle or heart shape). One or both of the sheets may be decorated or metallized to provide an aesthetically pleasing balloon. In addition, in comparison with latex balloons, non-latex balloons further have the advantage of a low level of permeability towards air or helium. However, non-latex balloons tend to show wrinkles at their heat-seal lines once they are inflated to a normally recommended inflation pressure. This is generally considered to be aesthetically undesirable, but until now has also generally been considered an unavoidable consequence of using the non-latex material.

Accordingly, a need exists for a non-latex balloon and a method of making and using such a balloon in which wrinkles at the heat-seal line are minimized after inflation.

SUMMARY OF THE INVENTION

It is therefore an object of the invention to provide a non-latex balloon and a method of making and using such a balloon in which wrinkles at the heat-seal line are minimized after inflation.

According to a first aspect of the invention, an inflated non-latex balloon includes at least two non-latex films that are sealed together at their edges to define an encapsulation member; and an inlet connected to the encapsulation member, wherein the encapsulation member is inflated to a pressure substantially higher than a normal inflating pressure recommended for a typical non-latex balloon, and wherein shape of the inflated non-latex balloon is different in comparison with what the shape of the balloon would have been if the balloon would have been inflated to the normal inflating pressure.

According to a second aspect of the invention, a method of making a non-latex balloon involving the steps of cutting at least two non-latex films into first shapes that are substantially different from desired shape of the non-latex balloon by factoring in stretchy properties of the at least two non-latex films when the non-latex balloon is inflated to a pressure that is substantially higher than a normal inflating pressure recommended for a typical non-latex balloon; and sealing the edges of the at least two non-latex films to form to an encapsulation member.

According to a third aspect of the invention, a method of inflating a non-latex balloon involving the step of: inflating the non-latex balloon to a pressure substantially higher than a normal inflating pressure recommended for a typical non-latex balloon, wherein the non-latex balloon is designed to be over-inflated to result in a desired shape.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 1 schematically illustrates a non-latex balloon that can be inflated according to the invention.

FIG. 2 illustrates one embodiment of a pair of heat-sealable sheets that are used to prepare a balloon according to the invention.

FIG. 3 schematically illustrates a process of producing a non-latex balloon that can be inflated according to the invention.

FIG. 6 schematically compares the wrinkles of a normally inflated balloon with an over-inflated balloon.

FIG. 7 illustrates a roll of sheets that can be used in the invention, where the sheets have different stretchabilities in different directions.

FIG. 8 schematically illustrates the shape distortion occurred for an over-inflated balloon that is produced using the sheets illustrated in FIG. 7.

FIG. 9 schematically illustrates the shape distortion that occurs in an over inflated balloon that is produced according to an alternative embodiment of the invention.

FIG. 10 schematically illustrates a balloon that is formed according to an alternative embodiment of the invention.

FIG. 11 schematically illustrates the shape distortion that occurs in an over inflated balloon that is produced according to the embodiment of FIG. 10.

DETAILED DESCRIPTION OF THE PREFERRED EMBODIMENT(S)

Figure 4:
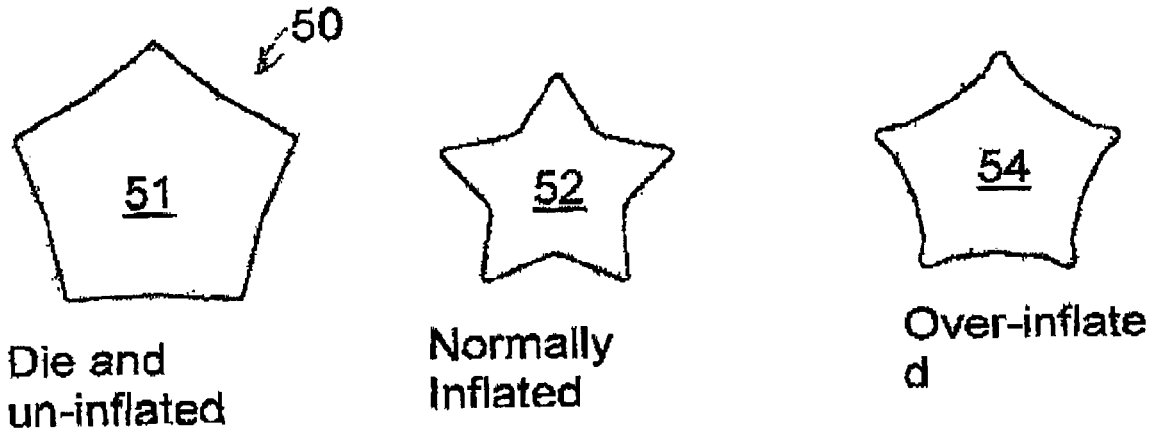
FIG. 4 schematically illustrates the shape transformation of a balloon when it is uninflated, normally inflated and over-inflated.

Referring now to the drawings, wherein like reference numerals designate corresponding structure throughout the views, and referring in particular to FIG. 1, a balloon 12 includes a body 14 and a stem 16, defined by two flexible plastic balloon sheets 18 of a non latex plastic heat-sealable material, and a self-sealing valve 10 located in the stem 16. Looking now to FIG. 2, it will be seen that each of the sheets 18 preferably includes a first layer 40, which is preferably fabricated of a biaxially oriented nylon 6, a second layer 42 of Ethylene Vinyl Alcohol copolymer, a third layer 44 of biaxially oriented nylon 6 and a fourth layer 46 of linear low density polyethylene.

The body 14 of the balloon 12 is inflatable with an inflating gas, such as air or helium, through the stem 16. For purposes hereof, the stem 16 extends from a boundary 34, shown as a dashed line in FIG. 1 and is defined by a relatively smooth, continuous extension of the heat seal line 32 in the region of the stem 16.

With particular reference to FIGS. 2 and 3, the heat-sealable balloon sheets 18 are provided together in roll form, with each sheet 18 preferably having a width of about three feet. A roll 36 will supply a continuous web of two juxtaposed sheets 18, as may be seen in the cross-sectional view that is depicted in FIG. 2. The two juxtaposed sheets 18 are arranged so that the respective fourth layers 46 of linear low density polyethylene face each other. In practice, this positioning may be achieved by folding a single sheet 18 over itself. As may be seen in FIG. 3, after printing, the two sheets 18 are aligned, registered and passed through a die assembly 42 that includes a first sealing die 43 and a cutting die 45 that together will seal and cut the individual balloon members that are being manufactured from the sheets 18. A valve member 10 will then be installed within each balloon member, as is well known in the industry.

According to one important aspect of the invention, the heat-sealable sheet 18 is a stretchable material that will elongate under tension more along one axis that it will along a second, orthogonal axis. Therefore, upon being inflated to a higher pressure, such as 1.0 psi over the atmosphere pressure, than a normally recommended inflating pressure (which is typically set to be 0.65 psi over the atmosphere pressure), the shape of balloon 12 may be distorted to a shape that is substantially different from what the shape of the balloon 12 would have been had the balloon 12 been inflated to the normally recommended inflation pressure. For example, a normal uninflated star shaped balloon 51 made from a die 50 (therefore, having a same shape as the die 50) would be inflated to the normally recommended pressure to result in a normally inflated star-shaped balloon 52 as shown in FIG. 4. When the normal uninflated star shape balloon 51 is inflated to a pressure (e.g. 1.0 psi over the atmosphere pressure, also called "over-inflating") substantially higher than the normally recommended inflating pressure, it results in a distorted shaped balloon 54, which is substantially different from the normally inflated balloon 52.

Figure 5:
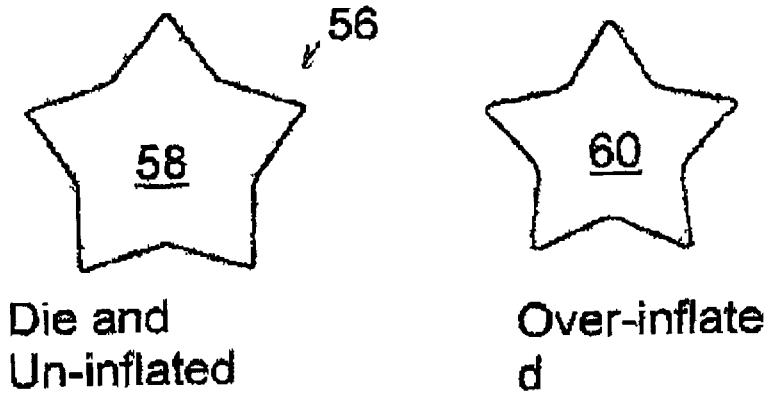
FIG. 5 schematically illustrates that a design of a star shape balloon by taking into account of the distortion caused by over-inflating a balloon.

According to one important aspect of the invention, it has been found to be advantageous to take into account the shape distortion that occurs during the over-inflation of a balloon when one designs and/or manufactures a balloon. For example, instead of using the die 50, one can use die 56 to produce a balloon 58, which can be over-inflated to a pressure substantially higher than the normally recommended pressure to achieve a desired star shape balloon 60 as shown in FIG. 5.

One advantage of intentionally over-inflating a balloon is that it reduces the wrinkles 66 at the heat-seal line 32 of the balloon. Another advantage is that it will hold more helium so it will float longer. For example, as shown in FIG. 6, an over-inflated balloon 62 according to the invention has significantly less wrinkles 66 on its heat-seal line 32 when compared with a normally inflated balloon 64.

Preferably, a balloon that is constructed according to the invention is over-inflated to a pressurization that is within a range of about 0.8 psi over atmosphere to about 2.0 psi over atmosphere. More preferably, the inflation is within a range of about 0.9 psi over atmosphere to about 1.6 psi over atmosphere. Most preferably, the inflation is within range of about 0.95 psi over atmosphere to about 1.5 psi over atmosphere.

In one embodiment, the stretchability of the heat-sealable sheet 18 used in manufacturing the balloon 12 of the invention is different in different stretching directions. For example, a roll of film 68 shown in FIG. 7 has different tensile moduli of elasticity and stretching limits in its longitudinal (y-axis) and lateral (x-axis) directions, respectively. FIG. 8 illustrates a balloon 70 made from the film 68 in its die-cut, uninflated state. When the balloon 70 is inflated to a pressure substantially higher than the normally recommended inflating pressure, it results a balloon 72, which is stretched more in its longitudinal direction than in its lateral direction to achieve a particular desired visual effect. It will be noted that inflated balloon 72 has the familiar rounded, wrinkle-free appearance of a latex balloon. The balloon will also float longer because of the additional amount of helium it contains.

In another embodiment of the invention, which is depicted in FIG. 9, it will be seen that a balloon 74 that is inflated to a normal inflation pressure of about 0.65 psi is noticeably elongated, having what could be described as an egg-shaped profile. In this embodiment, the balloon 74 is fabricated from a biaxially expandable material that will expand under overpressure more in the lateral direction than in the longitudinal direction. Accordingly, when the balloon is over-pressured as described above, it will expand into a final shape 76 that is a close approximation of a sphere, as is shown in FIG. 9.

FIGS. 10 and 11 show yet another embodiment of the invention in which a more complex shape is given to a balloon blank 78, in this case the shape of a fish. When over-pressured, the balloon will assume a fuller, rounder shape 79, as is shown in FIG. 11.

It is to be understood, however, that-even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An inflated non-latex balloon comprising:

at least two non-latex films that are sealed together at their edges to define an encapsulation member, wherein each of said non-latex films are cut into a predetermined shape that compensates for inflation pressures substantially higher than a normal inflating pressure of 0.65 psi over atmosphere pressure and further having elastic properties that compensate for said inflation pressures; and an inlet connected to said encapsulation member, wherein said encapsulation member is inflated to a first pressure substantially higher than a normal inflating pressure of 0.65 psi over atmosphere pressure, and wherein shape of said inflated non-latex balloon is different in comparison with shape of said balloon if said balloon would be inflated to said normal inflating pressure.

2. An inflated non-latex balloon as claimed in claim 1, wherein said non-latex films have different tensile moduli of elasticity in different stretch directions.

3. An inflated non-latex balloon as claimed in claim 2, wherein said inflated non-latex balloon is stretched substantially more in a first direction than in a second direction that is perpendicular to the first direction.

4. An inflated non-latex balloon as claimed in claim 1, wherein said first pressure is within a range of about 0.8 psi over atmosphere to about 2.0 psi over atmosphere.

5. An inflated non-latex balloon as claimed in claim 4, wherein said first pressure is within a range of about 0.9 psi over atmosphere to about 1.6 psi over atmosphere.

6. An inflated non-latex balloon as claimed in claim 5, wherein said first pressure is within a range of about 0.95 psi over atmosphere to about 1.5 psi over atmosphere.

7. A method of making a non-latex balloon comprising the steps of:

cutting at least two non-latex films into first shapes that are different from a desired final shape of the non-latex balloon by compensating for the shape of said at least two non-latex films when the non-latex balloon is inflated to a first pressure that is substantially higher than a normal inflating pressure of 0.65 psi over atmosphere pressure, wherein said non-latex films have elastic properties that compensate for said first pressure; and sealing the edges of the at least two non-latex films to form an encapsulation member.

8. A method of making a non-latex balloon as claimed in claim 7, wherein the step of cutting the at least two non-latex films are carried out using at least one die having the first shape.

9. A method as claimed in claim 7, wherein said first pressure is within a range of about 0.8 psi over atmosphere to about 2.0 psi over atmosphere.

10. A method as claimed in claim 9, wherein said first pressure is within a range of about 0.9 psi over atmosphere to about 1.6 psi over atmosphere.

11. A method as claimed in claim 10, wherein said first pressure is within a range of about 0.95 psi over atmosphere to about 1.5 psi over atmosphere.

12. A method of inflating a non-latex balloon comprising the step of:

providing a non-latex balloon that is designed to be overinflated by having constructed said non-latex balloon by compensating for the stretching limits of said non-latex balloon to result in a desired shape at a first inflating pressure greater than 0.65 psi over atmosphere pressure, and wherein said non-latex films have elastic properties that compensate for said first pressure; and inflating said non-latex balloon to a first pressure substantially higher than a normal inflating pressure 0.65 psi over atmosphere pressure, whereby the balloon assumes the desired shape.

13. A method as claimed in claim 12, wherein said non-latex balloon has a shape upon being inflated to the pressure substantially higher than the normal pressure that is substantially aesthetically different from a shape when said non-latex balloon is inflated to the normal pressure.

14. A method as claimed in claim 12, wherein said first pressure is within a range of about 0.8 psi over atmosphere to about 2.0 psi over atmosphere.

15. A method as claimed in claim 14, wherein said first pressure is within a range of about 0.9 psi over atmosphere to about 1.6 psi over atmosphere.

16. A method as claimed in claim 15, wherein said first pressure is within a range of about 0.95 psi over atmosphere to about 1.5 psi over atmosphere.

* * * * *